US008314172B2

(12) United States Patent
Hirau et al.

(10) Patent No.: US 8,314,172 B2
(45) Date of Patent: Nov. 20, 2012

(54) GOLF BALL

(75) Inventors: Tsutomu Hirau, Kobe (JP); Kazuhiko Isogawa, Kobe (JP); Satoko Okabe, Kobe (JP)

(73) Assignee: SRI Sports Limited, Kobe (JP)

( * ) Notice: Subject to any disclaimer, the term of this patent is extended or adjusted under 35 U.S.C. 154(b) by 407 days.

(21) Appl. No.: 12/647,115

(22) Filed: Dec. 24, 2009

(65) Prior Publication Data

US 2010/0167840 A1 Jul. 1, 2010

(30) Foreign Application Priority Data

Dec. 26, 2008 (JP) ..... 2008-335264

(51) Int. Cl.

| | |
|---|---|
| ***A63B 37/12*** | (2006.01) |
| ***A63B 37/00*** | (2006.01) |
| ***C08L 77/00*** | (2006.01) |
| ***C08L 33/02*** | (2006.01) |

(52) U.S. Cl. ..... 524/322; 524/394; 524/400; 525/66; 525/179; 525/182; 525/183; 173/373; 173/376; 173/378; 173/385

(58) Field of Classification Search ..... None
See application file for complete search history.

(56) References Cited

U.S. PATENT DOCUMENTS

| | | | |
|---|---|---|---|
| 5,210,138 | A | 5/1993 | Yamamoto et al. |
| 5,919,862 | A | 7/1999 | Rajagopalan |
| 5,977,264 | A | 11/1999 | Ichikawa et al. |
| 6,042,488 | A | 3/2000 | Sullivan et al. |
| 6,187,864 | B1 | 2/2001 | Rajagopalan |
| 6,274,669 | B1 | 8/2001 | Rajagopalan |
| 6,277,035 | B1 | 8/2001 | Sullivan et al. |
| 6,353,058 | B1 | 3/2002 | Rajagopalan |
| 6,702,694 | B1 | 3/2004 | Watanabe |
| 2004/0116211 | A1 | 6/2004 | Sullivan et al. |
| 2004/0142770 | A1 | 7/2004 | Watanabe |

FOREIGN PATENT DOCUMENTS

| | | | |
|---|---|---|---|
| GB | 2 267 908 | A | 12/1993 |
| JP | 60-60867 | A | 4/1985 |
| JP | 3-64343 | A | 3/1991 |
| JP | 6-80718 | A | 3/1994 |
| JP | 9-10357 | A | 1/1997 |
| JP | 9-70451 | A | 3/1997 |
| JP | 10-314341 | A | 12/1998 |
| JP | 2001-509204 | A | 7/2001 |
| JP | 2001-514561 | A | 9/2001 |
| JP | 2004-97802 | A | 4/2004 |
| JP | 2004-188207 | A | 7/2004 |
| JP | 2001-514561 | A | 9/2011 |

OTHER PUBLICATIONS

English translation of Japanese Notice of Reasons for Rejection dated Jan. 17, 2012 for Japanese Application No. 2008-335264.
Notice of Reasons for Rejection dated Apr. 19, 2011 for Japanese Application No. 2008-335264.

*Primary Examiner* — David Buttner
(74) *Attorney, Agent, or Firm* — Birch, Stewart, Kolasch & Birch, LLP

(57) ABSTRACT

An object of the invention is to provide a golf ball excellent in the durability at the normal and low temperatures, flight distance, direction stability and shot feeling on the shots. The present invention provides a golf ball comprising: a core consisting of a center having a diameter of 35 mm or less and a surrounding layer covering the center; at least one intermediate layer covering the core, said intermediate layer having a thickness ranging from 0.5 mm to 1.2 mm and a density of 1.10 g/cm$^3$ or more; and a cover covering the intermediate layer and having a thickness ranging from 0.3 mm to 1.0 mm, wherein the cover is formed of a cover composition that has a slab hardness ranging from 65 to 75 in Shore D hardness and contains as a resin component; (A) a polyamide resin composition having a flexural modulus in a range from 700 MPa to 4,000 MPa and a melt flow rate (240° C., 2.16 kg) of 5.0 g/10 min or more; (B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

20 Claims, 3 Drawing Sheets

GOLF BALL

FIELD OF THE INVENTION

The present invention relates to a golf ball, in particular, to a technology for improving a flight distance, a direction stability, and a shot feeling on the shots while maintaining durability at normal and low temperatures.

DESCRIPTION OF THE RELATED ART

So far, in order to improve a flight distance of golf balls, a method of using a large core composed of a rubber composition having a high rebound property with a thinner cover in the golf balls has been known. However, since the volume of the cover layer decrease with the thinner cover, the stiffness of the cover layer is lowered. As a result, there is a problem that the spin rate increases on the driver shot.

In order to solve these problems, it has been proposed to use a resin having a high stiffness as a cover composition for forming the cover. For example, Japanese Patent Publication Nos. H6-80718 and H9-10357 disclose a golf ball using a cover composition containing an ionomer resin having a high acid content as a resin component. Japanese Patent Publication No. H10-127822 discloses a golf ball using a cover composition containing a diamine complex of an ionomer resin as a resin component. However, in the case of using the ionomer resin having a high acid content or the diamine complex of the ionomer resin, the shot feeling was poor, although the modulus was improved. Especially, the durability of the golf ball was lowered in the thin cover construction. Further, in the case of using the ionomer resin having a high neutralized degree, the moldability of the cover composition was lowered.

Therefore, a technology for a high stiffness has been proposed without using the above ionomer resins having a high acid content or a high neutralized degree. For example, Japanese Patent Publication No. 2001-509204T discloses a use of a compatibilized blend comprising about 4 percent to 95 percent of at least one ionomer resin; about 95 percent to 4 percent of at least one non-ionic polymer; and about 1 to 15 phr, based on 100 parts ionomer resin and non-ionic polymer, of at least one non-carboxylic acid compatibilizer comprising a material selected from the group consisting of functionalized block and graft polymers, oligomers, and mixtures thereof, wherein at least one portion of the non-carboxylic acid compatibilizer is miscible with the at least one ionomer and at least one portion of the non-carboxylic acid compatibilizer is miscible with the at least one non-ionic polymer. Japanese Patent Publication No. 2001-514561T discloses a use of a composition comprising a substantially compatibilizer-free blend of about 10 wt. % to about 80 wt. % of at least one ionomer and about 90 wt. % to about 20 wt. % of at least one polyamide polymer.

In Japanese Patent Publications No. 2001-509204T and No. 2001-514561T, although the non-ionic polymer or the polyamide polymer is mixed with the ionomer resin, the resin having a relatively low modulus is blended in order to improve the shot feeling. Thus, the modulus of the cover is insufficient in the thin cover construction, and there remains a problem that the spin rate off the driver shot increases.

Japanese Patent Publication No. H10-314341 discloses a cover material for the golf ball comprising a rubber modified thermoplastic resin composition, which is obtained by mixing a functionalized rubbery copolymer to a base resin comprising an ionomer resin, a non-ionomer thermoplastic elastomer, or a mixture thereof. This cover material provides the improved effect of the shot feeling and the durability. However, there remains a problem that the durability is in sufficient in the thin cover construction.

SUMMARY OF THE INVENTION

So far, in golf balls having a multi-piece structure, various approaches have been employed in order to provide a great flight distance in combination with a thin cover. For example, the larger diameter of the core made of a rubber composition enhances a repulsion. The higher specific gravity of the intermediate layer increases the moment of inertia of the golf ball, thereby reducing the back spin or side spin. The smaller diameter of the center in the two-layered construction of the core reduces a back spin while maintaining the good shot feeling.

However, in the case of employing the thin cover, if the stiffness of the cover layer became low as the cover was getting thin, there raise a problem that the back spin rate increase. In order to resolve the lowering of the stiffness caused by the thin cover, the material having a higher stiffness has been studied as the cover material. However, if the resin having a high stiffness is used, there raised problems that the durability and the repulsion of the golf ball are insufficient in the thin cover construction.

The present invention has been made in view of the above circumstances, and an object of the invention is to provide a golf ball excellent in a flight distance, a direction stability, and a shot feeling on the shots in addition to durability at normal and low temperatures.

The present invention, which has solved the above problem, provides a golf ball comprising:

a core consisting of a center having a diameter of 35 mm or less and a surrounding layer covering the center;

at least one intermediate layer covering the core, said intermediate layer having a thickness ranging from 0.5 mm to 1.2 mm and a density of 1.10 g/cm$^3$ or more; and a cover covering the intermediate layer and having a thickness ranging from 0.3 mm to 1.0 mm, wherein the cover is formed of a cover composition that has a slab hardness ranging from 65 to 75 in Shore D hardness and contains as a resin component;

(A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group);

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

Namely, since the cover composition of the present invention contains (A) component, (B) component, and (C) component, the repulsion and the fluidity of the cover composition improves. As a result, if the cover layer is formed of the above cover composition, the cover layer with the high elasticity and the improved low temperature durability is provided. In the present invention, use of the above cover composition allows the golf ball to have a thinner cover, a core having an outer hard-inner soft structure, and a center having a reduced diameter, thereby lowering the spin rate on the driver shots, while maintaining the durability at normal and low temperatures. Accordingly, the flight distance and the direction stability are improved, and the shot feeling is not deteriorated even if the cover has a high hardness.

According to the present invention, a golf ball excellent in the durability at the normal and low temperatures as well as the flight distance, direction stability and shot feeling on the shots is obtained.

DESCRIPTION OF THE PREFERRED EMBODIMENT

Figure 1:
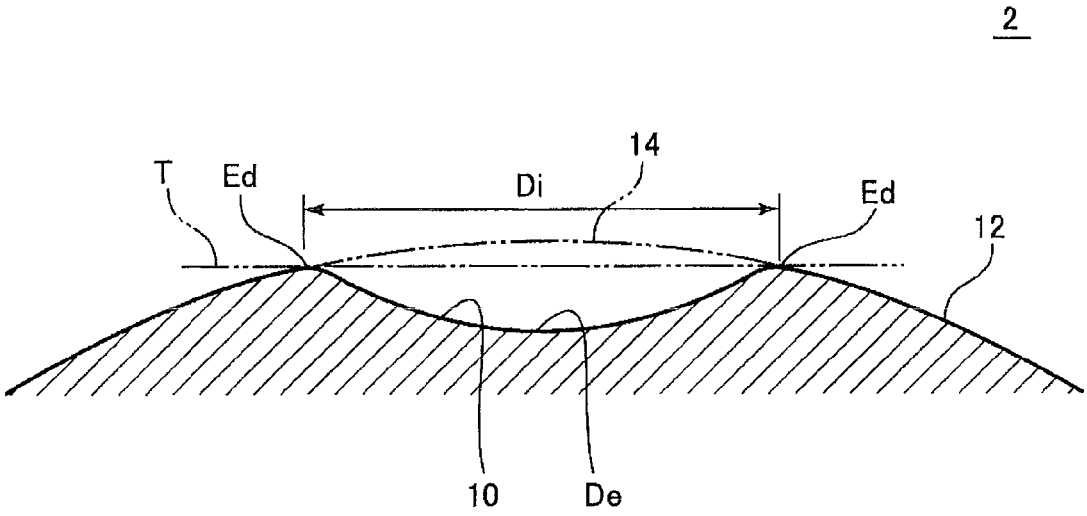
FIG. 1 is an expanded sectional view of the dimples formed on the surface of the golf ball body.

The present invention provides a golf ball comprising:

a core consisting of a center having a diameter of 35 mm or less and a surrounding layer covering the center;

at least one intermediate layer covering the core, said intermediate layer having a thickness ranging from 0.5 mm to 1.2 mm and a density of 1.10 g/cm$^3$ or more; and a cover covering the intermediate layer and having a thickness ranging from 0.3 mm to 1.0 mm, wherein the cover is formed of a cover composition that has a slab hardness ranging from 65 to 75 in Shore D hardness and contains as a resin component;

(A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group);

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

First, (A) the polyamide resin composition having a flexural modulus in a range from 700 MPa to 4,000 MPa and a melt flow rate (240° C., 2.16 kg) of 5.0 g/10 min or more (hereinafter, sometimes merely referred to as "(A) polyamide resin composition") will be explained.

The melt flow rate (240° C., 2.16 kg) of (A) the polyamide resin composition is preferably 5.0 g/10 min or more, more preferably 6.0 g/10 min or more, and even more preferably 7.0 g/10 min or more, and is preferably 150 μl 0 min or less, more preferably 140 g/10 min or less, and even more preferably 130 g/10 min or less. If the melt flow rate of (A) the polyamide resin composition falls within the above range, since the fluidity of the cover composition becomes good, it is possible to make a thin cover. Thus, the spin rate can be reduced upon a shot with a driver or the like, thereby obtaining a great flight distance.

The flexural modulus of (A) the polyamide resin composition is 700 MPa or more, preferably 750 MPa or more, and more preferably 800 MPa or more, and is 4,000 MPa or less, preferably 3,500 MPa or less, and more preferably 3,000 MPa or less. If the flexural modulus of (A) the polyamide resin composition is 700 MPa or more, the cover has a sufficient resilience, and hence the effect of reducing the spin rate when hitting the driver shot is obtained. If the flexural modulus of (A) the polyamide resin composition is 4,000 MPa or less, the cover is not excessively hard, and thus the shot feeling and durability becomes good.

(A) The polyamide resin composition contains (a-1) a polyamide resin and (a-2) a resin having at least one functional group selected from the group consisting of a hydroxyl group, a carboxyl group, an anhydride group, a sulfonic acid group, and an epoxy group (including a glycidyl group). Containing (a-2) component improves the impact resistance of (A) the polyamide resin composition, and thus the durability of the golf ball is improved.

(a-1) The polyamide resin contained in (A) the polyamide resin composition will be explained. (a-1) The polyamide resin is not limited, as long as it is a polymer having plurality of amide bonds (—NH—CO—) in a main molecular chain. Examples of (a-1) the polyamide resin include a product having an amide bond formed by a ring-opening polymerization of lactam or a reaction between a diamine component and a dicarboxylic acid component.

Examples of the lactam include ϵ-caprolactam, undecane caprolactam, lauryl caprolactam. Examples of the diamine include hexamethylenediamine, nonanediamine, methylpentadiamine, p-phenylenediamine, m-phenylenediamine, p-xylylenediamine, and m-xylylenediamine. Examples of the dicarboxylic acid include adipic acid, azelaic acid, sebacic acid, terephthalic acid, and isophthalic acid.

Examples of (a-1) the polyamide resin are, an aliphatic polyamide such as polyamide 6, polyamide 11, polyamide 12, polyamide 66, polyamide 610, polyamide 6T, polyamide 6I , polyamide 9T, polyamide M5T, polyamide 612; an aromatic polyamide such as poly-p-phenyleneterephthalamide, poly-m-phenyleneisophthalamide; an amide copolymer such as a polyetherblock amide copolymer, a polyester amide copolymer, a polyether-ester amide copolymer, a polyamideimide copolymer. These polyamides may be used individually or in combination of at least two of them. Among them, the aliphatic polyamide such as polyamide 6, polyamide 66, polyamide 11, polyamide 12 is preferable.

Specific examples of (a-1) the polyamide resin include, "Rilsan (registered trademark) B (for example, Rilsan BESN TL, Rilsan BESN P20 TL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 D)" available from Arkema Inc.

(a-2) The resin having at least one functional group selected from the group consisting of a hydroxyl group, a carboxyl group, an anhydride group, a sulfonic acid group, and an epoxy group (including a glycidyl group) (hereinafter, sometimes merely referred to as "(a-2) functional group-containing resin") contained in (A) the polyamide resin composition will be explained.

(a-2) The functional group-containing resin is not limited, as long as it has at least one functional group selected from the group consisting of a hydroxyl group (—OH), a carboxyl group (—COOH), an anhydride group (–CO—O—CO—), a sulfonic acid group (—$SO_3H$), and an epoxy group (—COC—)(including a glycidyl group). It is noted that (a-2) the functional group-containing resin does not include an ethylene-(meth)acrylic acid binary copolymer, a metal-neutralized product of the binary copolymer, an ethylene-(meth) acrylic acid-(meth)acrylic acid ester ternary copolymer, a metal-neutralized product of the ternary copolymer used as (B), a nonionic thermoplastic resin having a melt viscosity (190° C.) ranging from 5 Pa·s to 1,000 Pa·s measured by a flow tester and an ionomer resin having a melt viscosity (190° C.) ranging from 1 Pa·s to 10 Pa·s measured by a brookfield viscometer used as (C) a fluidity improving agent, which are described later.

(a-2) The functional group-containing resin is preferably, for example, without limitation, a thermoplastic elastomer. Examples of the thermoplastic elastomer include a thermoplastic polyolefin elastomer, a thermoplastic polyester elastomer, a thermoplastic polyamide elastomer, a thermoplastic polyurethane elastomer, and a thermoplastic polystyrene elastomer. Among them, the thermoplastic polyolefin elastomer and the thermoplastic polystyrene elastomer are preferable, and the thermoplastic polystyrene elastomer is more preferable.

The thermoplastic polyolefin elastomer preferably contains ethylene as a component. Examples of the thermoplastic polyolefin elastomer having a functional group include an ethylene-glycidyl(meth)acrylate copolymer, an ethylene-(meth)acrylic acid ester-glycidyl(meth)acrylate copolymer, and an ethylene-glycidyl(meth)acrylate-vinyl acetate copolymer.

The polystyrene elastomer is preferably a hydrogenated product of a block copolymer consisting of a polystyrene block and a block mainly composed of a conjugated diene compound. Herein, a hydrogenated product of the block copolymer means that at least a part of unsaturated bonds derived from the conjugated diene compound in the block copolymer is hydrogenated. The polystyrene elastomer preferably includes a hydrogenated product (styrene-ethylene-butylene-styrene block polymer (SEBS)) of a block copolymer using 1,3-butadiene as the conjugated diene compound, and a hydrogenated product (styrene-ethylene/propylene-styrene (SEPS)) of a block copolymer using 2-methyl-1,3-butadiene as the conjugated diene compound.

Specific examples of (a-2) the resin having a functional group include thermoplastic polyolefin elastomers having a functional group such as "LOTARDER AX8840" manufactured by Arkema Inc., "ARUFON (registered trademark) UG-4030" manufactured by Toagosei Co., Ltd., "Bond Fast (registered trademark) E" manufactured by Sumitomo Chemical Co., Ltd.; and thermoplastic polystyrene elastomers having a functional group such as "Tuftec (registered trademark) M1913 and Tuftec M1943" manufactured by Asahi Kasei Corporation, "FUSABOND (registered trademark) NM052D" manufactured by E.I. du Pont de Nemours and Company, "Dynaron (registered trademark) 4630P" manufactured by JSR Corporation.

Specific examples of (A) the polyamide resin composition include "NOVAMID (registered trademark) ST120" available from Mitsubishi Engineering-Plastics Company.

The content of (A) the polyamide resin composition in the resin component contained in the cover composition is preferably 20 mass % or more, more preferably 25 mass % or more, and even more preferably 30 mass % or more, and is preferably 90 mass % or less, more preferably 85 mass % or less, and even more preferably 80 mass % or less. If the content of (A) the polyamide resin composition in the resin component contained in the cover composition is 20 mass % or more, the modulus of the cover becomes high. Thus, the effect of the high launch angle and low spin rate becomes larger. On the other hand, if the content of (A) the polyamide resin composition is 90 mass % or less, the modulus of the cover does not become excessively high. Thus, the resultant golf ball provides better shot feeling and durability.

Next, (B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer (hereinafter, sometimes merely referred to as "(B) copolymer and/or a metal-neutralized product thereof") will be explained.

The ethylene-(meth)acrylic acid binary copolymer (hereinafter, sometimes merely referred to as "binary copolymer") is a copolymer obtained by copolymerizing a monomer composition containing ethylene and (meth)acrylic acid. The ethylene-(meth)acrylic acid-(meth)acrylic acid ester ternary copolymer (hereinafter, sometimes merely referred to as "ternary copolymer") is a copolymer obtained by copolymerizing a monomer composition containing ethylene, (meth)acrylic acid, and (meth)acrylic acid ester. Examples of (meth)acrylic acid ester include methyl(meth)acrylate, ethyl(meth)acrylate, isopropyl(meth)acrylate, isobutyl(meth)acrylate, n-butyl(meth)acrylate, pentyl(meth)acrylate, hexyl (meth)acrylate, heptyl(meth)acrylate, isooctyl(meth)acrylate, and 2-ethylhexyl (meth)acrylate.

The content of the (meth)acrylic acid component in the binary copolymer or the ternary copolymer is preferably 2 mass % or more, more preferably 3 mass % or more, and is preferably 30 mass % or less, more preferably 25 mass % or less.

The binary copolymer or the ternary copolymer may be obtained by copolymerizing another monomer to the extent that the effect of the present invention is not impaired. Examples of another monomer are a vinyl ester such as vinyl acetate, vinyl propionate; an unsaturated carboxylate such as dimethyl maleate, diethyl maleate; carbon monoxide, sulfur dioxide. In the case that another monomer is used, the content of another monomer in the binary copolymer or the ternary copolymer is preferably 40 mass % or less, more preferably 30 mass % or less, even more preferably 20 mass % or less.

The binary copolymer or the ternary copolymer used as (B) component preferably has melt viscosity (190° C.) more than 1,000 Pa·s measured by a flow tester.

Examples of the binary copolymer or the ternary copolymer include "NUCREL (registered trademark) (e.g. binary copolymer such as NUCREL NO903HC or the like) manufactured by Du Pont-Mitsui Polychemicals Co., Ltd.

The metal-neutralized product of the ethylene-(meth) acrylic acid binary copolymer (hereinafter, sometimes merely referred to as "metal-neutralized binary copolymer") is a metal-neutralized product obtained by neutralizing at least a part of carboxyl groups of the binary copolymer with a metal ion. The metal-neutralized product of the ethylene-(meth)acrylic acid-(meth)acrylic acid ester ternary copolymer (hereinafter, sometimes merely referred to as "metal-neutralized ternary copolymer") is a metal-neutralized product obtained by neutralizing at least U a part of carboxyl groups of the ternary copolymer with a metal ion.

Examples of a metal (ion) used for the metal-neutralized binary or ternary copolymers include: monovalent metals (ions) such as sodium, potassium, lithium, and the like; divalent metals (ions) such as magnesium, calcium, zinc, barium, cadmium, and the like; trivalent metals (ions) such as aluminum and the like; and other metals (ions) such as tin, zirconium, and the like. Among these metals (ions), sodium, zinc and magnesium (ions) are preferably used because they provide excellent resilience, durability, or the like.

The degree of neutralization of the acidic groups contained in the metal-neutralized binary or ternary copolymers is preferably 20 mole % or more, more preferably 30 mole % or more, and is preferably 90 mole % or less, more preferably 85 mole % or less. The degree of neutralization of the acidic groups in the metal-neutralized binary or ternary copolymers can be calculated by using the following mathematical expression 1.

Degree of neutralization(mol %)=(the number of moles of acidic groups neutralized in a metal neutralized copolymer/the number of moles of all acidic groups contained in the metal neutralized copolymer)×100 [Mathematical Expression 1]

The metal-neutralized binary or ternary copolymer used as (B) component preferably has a melt viscosity (190° C.) ranging from 500 Pa·s to 100,000 Pa·s measured by a flow tester.

Specific examples of the metal-neutralized binary or ternary copolymers include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "lotek (registered trademark) (e.g. the binary copolymerized ionomer such as lotek 8000 (Na), lotek 8030 (Na), lotek 7010 (Zn), lotek 7030 (Zn); and the ternary copolymerized ionomer such as lotek 7510 (Zn), lotek 7520 (Zn))" commercially available from ExxonMobil Chemical Corporation.

The metal-neutralized binary or ternary copolymers may be used alone or as a mixture of at least two of them. It is noted that Na, Zn, Li, and Mg described in the parentheses after the trade names indicate metal types of neutralizing metal ions for the metal-neutralized copolymer.

As (B) the copolymer and/or a metal-neutralized product thereof used in the present invention, preferred is the metal-neutralized product of the ethylene-(meth)acrylic acid binary copolymer and/or the ethylene-(meth)acrylic acid-(meth) acrylic acid ester ternary copolymer, which is neutralized with at least one metal ion selected from the group consisting of Li, Na, Ca, Zn, Mg and Cu.

The flexural modulus of (B) the copolymer and/or a metal-neutralized product thereof is preferably 250 MPa or more, more preferably 260 MPa or more, and even more preferably 270 MPa or more, and is preferably 1,000 MPa or less, more preferably 800 MPa or less, and even more preferably 600 MPa or less. If the flexural modulus of (B) the copolymer and/or a metal-neutralized product thereof is 250 MPa or more, the cover becomes sufficiently stiff, and the effect of reducing the spin rate is obtained. On the other hand, if the flexural modulus of (B) the copolymer and/or a metal-neutralized product thereof is 1,000 MPa or less, the stiffness of the cover does not become excessively high, and the durability and the shot feeling of the golf ball improves.

The content of (B) the copolymer and/or a metal-neutralized product thereof in the resin component constituting the cover composition is preferably 10 mass % or more, more preferably 15 mass % or more, even more preferably 20 mass % or more, and is preferably 80 mass % or less, more preferably 75 mass % or less, and even more preferably 70 mass % or less. If the content of (B) the copolymer and/or a metal-neutralized product thereof in the resin component constituting the cover composition is 10 mass % or more, the repulsion and the durability of the golf ball becomes better. On the other hand, if the content of (B) the copolymer and/or a metal-neutralized product thereof is 80 mass % or less, the elastic modulus of the cover can be made in an appropriate range, and hence the effects of increasing the launch angle and reducing the spin rate becomes larger.

Next, (C) the fluidity improving agent will be described.

(C) The fluidity improving agent is a component improving the fluidity of a mixture of (A) component and (B) component. In the present invention, (C) the fluidity improving agent is not regarded as a resin component constituting the cover composition.

(C) The fluidity improving agent preferably includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer.

Examples of the fatty acid include, without limitation, saturated fatty acids such as butyric acid, valeric acid, hexanoic acid, heptanoic acid, octanoic acid, pelargonic acid, decanoic acid, lauric acid, myristic acid, palmitic acid, heptadecanoic acid, stearic acid, icosanoic acid, behenic acid, lignoceric acid, cerotic acid; and unsaturated fatty acids such as palmitoleic acid, oleic acid, linoleic acid, α-linolenic acid, γ-linolenic acid, and arachidonic acid.

The metal salts of the fatty acids include, without limitation, for example, metal salts of the fatty acids described above. Examples of the metal salts of the fatty acids include monovalent metal salts such as a sodium salt, a potassium salt, or a lithium salt of the fatty acids; divalent metal salts such as a magnesium salt, a calcium salt, a zinc salt, a barium salt, or a cadmium salt of the fatty acids; or a trivalent metal salts such as an aluminum salt of the fatty acids. Among them, divalent salts of the saturated fatty acids such as magnesium stearate, calcium stearate, zinc stearate, barium stearate, copper stearate are preferable.

The nonionic thermoplastic resin having a melt viscosity (190° C.) ranging from 5 Pa·s to 1,000 Pa·s measured by a flow tester, preferably includes a binary copolymer composed of ethylene and (meth)acrylic acid whose carboxyl groups are not neutralized, a ternary copolymer composed of ethylene, (meth)acrylic acid, and (meth)acrylic acid ester whose carboxyl groups are not neutralized, or a mixture thereof, which have a melt viscosity (190° C.) ranging from 5 Pa·s to 1,000 Pa·s measured by a flow tester.

Specific examples of the nonionic thermoplastic resin having a melt viscosity (190° C.) ranging from 5 Pa·s to 1,000 Pa·s measured by a flow tester are an ethylene-methacrylic acid copolymer having a commercial name of "NUCREL (registered trademark) (e.g. NUCREL N1560, NUCREL N1050H, NUCREL N2050H, NUCREL AN4318, NUCREL N1110H, NUCREL NO200H) or an ethylene-acrylic acid copolymer having a commercial name of "PRIMACOR (registered trademark)" 5990I" available from Du Pont-Mitsui Polychemicals Co., Ltd.

The ionomer resin having a melt viscosity (190° C.) ranging from 1 Pa·s to 10 Pa·s measured by a brookfield viscometer is not limited, and preferably includes, for example, a metal-neutralized product of the binary copolymer, and a metal-neutralized product of the ternary copolymer exemplified as (a-2) component, which have a melt viscosity (190° C.) ranging from 1 Pa·s to 10 Pa·s measured by a brookfield viscometer.

The ionomer resin having a melt viscosity (190° C.) ranging from 1 Pa·s to 10 Pa·s measured by a brookfield viscometer preferably includes a metal neutralized product of the binary copolymer composed of ethylene and (meth)acrylic acid and/or a metal neutralized product of the ternary copolymer composed of ethylene, (meth)acrylic acid, and (meth) acrylic acid ester, which is neutralized with at least one metal selected from the group consisting of Li, Na, Ca, Zn, Mg and Cu.

Specific examples of the ionomer resin having a melt viscosity (190° C.) ranging from 1 Pa·s to 10 Pa·s measured by a brookfield viscometer are "Aclyn (registered trade name) 201 (Ca)," "Aclyn246 (Mg)," and "Aclyn295 (Zn)" available from Honeywell Inc.

The fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer may be used alone or as a mixture of at least two of them. Among them, as (C) the fluidity improving agent in the present invention, the metal salt of the fatty acid or the binary copolymer composed of ethylene and (meth)acrylic acid having a melt viscosity (190° C.) ranging from 5 Pa·s to 1,000 Pa·s measured by a flow tester is preferable.

The content ratio ((A)/(B)) of (A) the polyamide resin composition to (B) the copolymer and/or a metal-neutralized product thereof (the total is 100 mass %) in the cover composition is preferably 20 mass % to 80 mass % 180 mass % to 20 mass %, more preferably 25 mass % to 75 mass %/75 mass % to 25 mass %, and even more preferably 30 mass % to 70 mass %/70 mass % to 30 mass %. By causing the content ratio of (A) the polyamide resin composition to (B) the copolymer and/or a metal-neutralized product thereof to be in the above range, the cover has an appropriate stiffness, and the launch angle is increased and the spin rate is reduced, thereby improving the flight distance of the golf ball. In addition, the shot feeling is improved.

The content of (C) the fluidity improving agent in the cover composition is preferably 1 part or more, more preferably 2 parts or more, even more preferably 3 parts or more, and is preferably 30 parts or less, more preferably 25 parts or less, even more preferably 20 parts or less with respect to 100 parts by mass of a sum of (A) the polyamide resin composition and (B) the copolymer and/or a metal-neutralized product thereof. If the content of (C) component is 1 part or more with respect to 100 parts by mass of a sum of (A) component and (B) component, the fluidity improving effect by (C) component becomes large, and thus the moldability of the cover is further improved. On the other hand, if the content of (C) component is 30 parts or less with respect to 100 parts by mass of a sum of (A) component and (B) component, the repulsion of the cover becomes good, and the distance of the golf ball is improved.

The cover composition may contain another resin component in addition to (A) the polyamide resin composition, (B) the copolymer and/or a metal-neutralized product thereof and (C) the fluidity improving agent, as long as another resin component does not impair the effects of the present invention. However, it is preferred that the resin component in the cover composition consists of (A) the polyamide resin composition, (B) the copolymer and/or a metal-neutralized product thereof, and (C) the fluidity improving agent.

The cover composition may further contain pigment components such as a white pigment (titanium oxide), a blue pigment, and a red pigment; a specific gravity adjusting agent such as barium sulfate, tungsten and the like; a dispersant; an antioxidant; an ultraviolet absorber; a light stabilizer; a fluorescent material or a fluorescent brightener and the like, as long as they do not impair the effect of the present invention.

The amount of the white pigment (titanium oxide), with respect to 100 parts by mass of the resin component, is preferably 0.5 part by mass or more and more preferably 1 part by mass or more, and is preferably 10 parts by mass or less and more preferably 8 parts by mass or less. By causing the amount of the white pigment to be 0.5 parts by mass or more, it is possible to provide opacity to the cover. If the amount of the white pigment is more than 10 parts by mass, the durability of the resultant cover may deteriorate.

In the present invention, the melt flow rate (240° C., 2.16 kg) of the cover composition is preferably 5.0 g/10 min or more, more preferably 7.0 g/10 min or more, and even more preferably 10.0 g/10 min or more, and is preferably 50.0 g/10 min or less, more preferably 45.0 g/10 min or less, and even more preferably 40.0 g/10 min or less. If the melt flow rate of the cover composition is 5.0 g/10 min or more, the fluidity of the cover composition becomes good, and it is possible to make a thin cover. Thus, the spin rate when hitting a driver shot is reduced to give a great flight distance. If the melt flow rate is 50.0 g/10 min or less, the cover does not become excessively hard. Thus, the flight distance is improved while suppressing the lowering of the durability.

The cover composition preferably has a slab hardness H5 of 65 or more, more preferably 66 or more, even more preferably 67 or more, and preferably has a slab hardness H5 of 75 or less, more preferably 73 or less, even more preferably 70 or less in Shore D hardness. If the slab hardness H5 is 65 or more in Shore D hardness, the hardness of the cover does not become excessively low, and the effect of the high launch angle and low spin rate on the driver shots becomes larger and the flight distance is further improved. If the slab hardness H5 is 75 or less in Shore D hardness, the cover does not become excessively hard, and thus the shot feeling of the golf ball becomes better.

The cover composition preferably has the flexural modulus of 350 MPa or more, more preferably 370 MPa or more, even more preferably 400 MPa or more, and preferably has the flexural modulus of 1,000 MPa or less, more preferably 950 MPa or less, even more preferably 900 MPa or less. If the flexural modulus is 350 MPa or more, the effect of the high launch angle and low spin rate on the driver shots becomes larger. If the flexural modulus is 1,000 MPa or less, the moldability of the cover composition becomes good, and the durability of the golf ball becomes better.

The cover composition preferably has the tensile modulus of 400 MPa or more, more preferably 410 MPa or more, even more preferably 420 MPa or more, and preferably has the tensile modulus of 2,000 MPa or less, more preferably 1,500 MPa or less, even more preferably 1,200 MPa or less. If the tensile modulus is 400 MPa or more, the effect of the high launch angle and low spin rate on the driver shots becomes larger. If the tensile modulus is 2,000 MPa or less, the durability of the golf ball becomes better.

The melt flow rate, flexural modulus, slab hardness, and tensile modulus can be measured by the later described method. The melt flow rate, flexural modulus, slab hardness, and tensile modulus can be adjusted appropriately by controlling a combination of (A) the polyamide resin component, (B)

the copolymer and/or a metal-neutralized product thereof and (C) the fluidity improving agent, the content of the additive or the like.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into a half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

When molding a cover, the concave portions called "dimple" are usually formed on the surface. FIG. 1 is an expanded sectional view of a part of a golf ball 2. This figure shows a cross-section which includes the deepest part De of a dimple 10 and the center of the golf ball 2. The up and down direction in FIG. 1 is the depth direction of the dimple 10. The depth direction is the direction from the gravity center of the area of the dimple 10 to the center of the golf ball 2. A chain double-dashed line 14 in FIG. 1 shows a virtual sphere. The surface of the virtual sphere 14 is the surface of the golf ball 2 in the case of assuming that there is no dimple 10. The dimple 10 is depressed from the surface of the virtual sphere 14. The surface of land 12 corresponds to the surface of the virtual sphere 14. In FIG. 1, the distance between the tangent line T and the deepest point De is the depth of the dimple 10.

Two headed arrow Di in FIG. 1 shows the diameter of the dimple 10. The diameter Di is the distance from one contact point Ed to another contact point Ed when a common tangent line T is drawn in both sides of the dimple 10. The contact points Ed are edges of the dimple 10. The edges Ed define the outline of the dimple 10. The diameter Di is preferably 2.0 mm or more and 6.0 mm or less. If the diameter Di is less than the above range, the dimple effect is hardly obtained and if the diameter Di exceeds 6.0 mm, the intrinsic property of the golf ball 2, that is, it is substantially spherical, is lost. The volume of the dimple means the volume of the portion surrounded by the curved plane including the outline of the dimple 10 and the virtual sphere 14. The total volume of the dimples 10 is preferably 250 $mm^3$ or more and 400 $mm^3$ or less. If the total volume is less than 250 $mm^3$, a hopping trajectory may be provided in some cases. If the total volume exceeds 400 $mm^3$, a dropping trajectory may possibly be provided.

In FIG. 1, the distance between the tangent line T and the deepest point De is the depth of the dimple 10. The depth is preferably 0.05 mm or more and 0.60 mm or less. If the depth is less than 0.05 mm, a hopping trajectory may be provided in some cases. On the other hand, if the depth exceeds 0.60 mm, a dropping trajectory may possibly be provided.

The total number of the dimples 10 formed on the cover is preferably 200 or more and 500 or less. If the total number is less than 200, the dimple effect is hardly obtained. On the other hand, if the total number exceeds 500, the dimple effect is hardly obtained because the size of the respective dimples 10 is small. The shape (shape in a plan view) of dimples 10 includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. This is because if the thickness is smaller than 5 μm, the paint film is easy to wear off due to continued use of the golf ball, and if the thickness is larger than 25 μm, the effect of the dimples is reduced, resulting in deteriorating flying performance of the golf ball.

In the present invention, the thickness of the cover of the golf ball is preferably 0.3 mm or more, more preferably 0.4 mm or more, even more preferably 0.5 mm or more, and is preferably 1.0 mm or less, more preferably 0.9 mm or less, even more than 0.8 mm or less. If the cover has a thickness of 0.3 mm or more, it is easy to mold the cover and the workability is improved. On the other hand, if the cover has a thickness of 1.0 mm or less, since the intermediate layer having the high specific gravity can be disposed in the relatively outer part of the golf ball, the effect of the low spin on the driver shot becomes larger due to the outer heavy inner light structure. Herein, the thickness is measured at the portion where the dimples are not formed, that is the thickness under the land 12 (refer to FIG. 1), and the thicknesses measured at least 4 portions are averaged.

Next, the golf ball construction in the present invention will be explained.

The golf ball of the present invention comprises a core consisting of a center having a diameter of 35 mm or less and a surrounding layer covering the center;

at least one intermediate layer covering the core, said intermediate layer having a thickness ranging from 0.5 mm to 1.2 mm and a density of 1.10 $g/cm^3$ or more; and a cover covering the intermediate layer and having a thickness ranging from 0.3 mm to 1.0 mm.

The core used in the present invention is a two-layered core consisting of a center and a surrounding layer covering the center.

As the center of the golf ball of the present invention, a conventionally known rubber composition (hereinafter simply referred to as "center rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber may be used. Examples of the base rubber are a polybutadiene rubber, a natural rubber, a polyisoprene rubber, a styrene polybutadiene rubber, and ethylene-propylene-diene terpolymer (EPDM). Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.3 part by mass or more, more preferably 0.4 part by mass or more, and is preferably 5 parts by mass or less, more preferably 3 parts by mass or less based on 100 parts by mass of the base rubber. If the amount is less than 0.3 part by mass, the center becomes too soft, and the repulsion tends to be lowered, and if the amount is more than 5 parts by mass, the amount of the co-crosslinking agent must be increased in order to obtain the appropriate hardness, which tends to cause the insufficient repulsion.

The co-crosslinking agent is not particularly limited as long as it serves to crosslink a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high repulsion.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the repulsion. On the other hand, if the amount of the co-crosslinking agent to be used is more than 55 parts by mass, the center becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 part or more, more preferably 1 part or more, and is preferably 30 parts or less, more preferably 20 parts or less based on 100 parts of the base rubber by mass. If the amount of the filler to be blended is less than 0.5 part by mass, it becomes difficult to adjust the weight, while if it is more than 30 parts by mass, the weight ratio of the rubber component becomes small and the repulsion tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, a diphenyl disulfide or a derivative thereof may be preferably used. Examples of the diphenyl disulfide or the derivative thereof include diphenyl disulfide, a mono-substituted diphenyl disulfide such as bis (4-chlorophenyl) disulfide, bis(3-chlorophenyl) disulfide, bis (4-bromophenyl) disulfide, bis(3-bromophenyl) disulfide, bis (4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis (3,5-dibromophenyl) disulfide, bis(2-chloro-5-bromophenyl) disulfide, and bis(2-cyano-5-bromophenyl) disulfide; a tri-substituted diphenyl disulfide such as bis (2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis (2,3,4,5,6-pentachlorophenyl) disulfide and bis(2,3,4,5,6-pentabromophenyl) disulfide. These diphenyl disulfides or the derivative thereof can enhance repulsion by having some influence on the state of vulcanization of vulcanized rubber. Among them, diphenyl disulfide and bis(pentabromophenyl) disulfide are preferably used since a golf ball having particularly high repulsion can be obtained. The amount of the diphenyl disulfide or the derivative thereof to be blended is preferably 0.1 part by mass or more, more preferably 0.3 part by mass or more, and preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The center can be obtained by mixing, kneading, and molding the rubber composition in the molds. The conditions for press-molding the center rubber composition should be determined appropriately depending on the rubber composition. For example, the press-molding is preferably carried out at the temperature from 130° C. to 200° C. for 10 to 60 minutes. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

Next, the surrounding layer in the core consisting of the center and an surrounding layer covering the center will be described.

Examples of the resin component of the surrounding layer composition for forming the surrounding layer include, in addition to the rubber composition described above, an ionomer resin having a trade name "Himilan (registered trademark) (e.g. "Himilan 1605" and "Himilan 1706") available from Du Pont-Mitsui Polychemicals Co., Ltd., an ionomer resin having a trade name "Surlyn (registered trademark) (e.g. "Surlyn 8140" and Surlyn "9120") available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark)" commercially available from Mitsubishi Chemical Corporation, and the like. These resins and elastomers may be used solely or in combination of two or more types thereof. Among them, since the relatively low hardness and the high rebound property are required for the surrounding layer, the rubber composition containing the rubber component as a main component is preferably used. Typically preferred is the high cis-polybutadiene having cis-1,4-bond in a proportion of 40% or more, more preferably 70% or more, even more preferably 90% or more in view of its superior repulsion property.

The surrounding layer is formed by, for example, covering the center with the surrounding layer composition. Examples of the method for forming the surrounding layer includes, without any limitation, a method which comprises molding the surrounding layer composition into a hollow-shell, covering the center with a pair of the upper and lower half hollow-shells and subjecting the center to the press-molding under the condition of 170° C. for 20 minutes in the upper and lower molds having spherical cavities.

Next, the structure of the two-layered core consisting of the center and an surrounding layer covering the center will be explained.

The center preferably has a diameter of 35 mm or less. If the center has a diameter of 35 mm or less, since the thickness of the surrounding layer can be ensured, the effect of increasing the launch angle and decreasing the spin rate on the driver shots can be obtained. The center preferably has a diameter of 33 mm or less, more preferably 32 mm or less, and preferably has a diameter of 10 mm or more, more preferably 15 mm or more. If the diameter of the center is 33 mm or less, since the thickness of the surrounding layer can be made thicker, the effect of increasing the launch angle and decreasing the spin rate on the driver shots becomes larger. If the diameter is 10 mm or more, since the hardness difference (H3−H1) between the surface hardness H3 and the center hardness H1 of the core can be made large, the effect of suppressing the spin rate on the driver shots becomes larger.

When the center has a diameter in a range from 10 mm to 35 mm, a compression deformation amount of the center (an compression amount of the center in the compression direction thereof) when applying an initial load of 98 N to a final load of 1275 N is preferably 2.5 mm or more, more preferably 2.7 mm or more, even more preferably 3.0 mm or more and is preferably 7.0 mm or less and more preferably 6.5 mm or less, even more preferably 6.0 mm or less. If the compression deformation amount is 2.5 mm or more, the effect of suppressing the spin rate on the driver shots and the shot feeling are enhanced. On the other hand, if the compression deformation amount is 7.0 mm or less, the repulsion becomes better.

The surrounding layer preferably has a thickness of 15 mm or less, more preferably 10 mm or less, even more preferably 5 mm or less, and preferably has a thickness of 2 mm or more, more preferably 2.5 mm or more. If the surrounding layer has a thickness of 15 mm or less, the shot feeling on the driver shots becomes better. On the other hand, if the thickness is 2 mm or more, since the diameter of the center can be made larger, the effect of lowering the spin rate on the driver shots becomes larger.

The diameter of the core is preferably 37 mm or more, more preferably 38 mm or more, and even more preferably 38.5 mm or more, and is preferably 41 mm or less, more preferably 40.5 mm or less, and even more preferably 40 mm or less. If the diameter of the core falls within the above range, the effect of suppressing the spin rate on the driver shots becomes larger.

When the core has a diameter in a range from 38.5 mm to 40 mm, a compression deformation amount of the core (an compression amount of the multi-piece core in the compression direction thereof) when applying an initial load of 98 N to a final load of 1275 N is preferably 2.7 mm or more, more preferably 2.9 mm or more, even more preferably 3.2 mm or more and is preferably 4.5 mm or less and more preferably 4.2 mm or less, even more preferably 3.8 mm or less. If the compression deformation amount is 2.7 mm or more, the effect of suppressing the spin rate and the shot feeling on the driver shots are enhanced. On the other hand, if the compression deformation amount is 4.5 mm or less, the repulsion becomes better.

The center hardness H1 of the core (the center) is preferably 22 or larger, more preferably 25 or larger, and even more preferably 28 or larger in Shore D hardness. If the center hardness H1 is 22 or larger in Shore D hardness, the core does not become too soft, resulting in the good repulsion. The center hardness H1 of the core is preferably 42 or smaller, more preferably 40 or smaller, and even more preferably 38 or smaller in Shore D. If the center hardness H1 is 42 or less in Shore D hardness, the core does not become too hard, resulting in the good shot feeling. In the present invention, the center hardness of the core is the hardness measured with the Shore D type spring hardness tester at the central point of a cut plane of the core which has been cut into two halves.

The surface hardness H2 in Shore D hardness of the center is preferably 44 or more, more preferably 46 or more, and even more preferably 48 or more. If the surface hardness H2 in Shore 0 hardness of the center is 44 or more, the center does not become excessively soft, resulting in good shot feeling. The surface hardness H2 in Shore D hardness of the center is preferably 60 or less, more preferably 58 or less, and even more preferably 56 or less. If the surface hardness H2 in Shore D hardness of the center is 60 or less, the center does not become excessively hard, resulting in good shot feeling.

The surface hardness H3 of the core is preferably 55 or larger, more preferably 57 or larger, and even more preferably 59 or larger in Shore D hardness. If the surface hardness H3 is 55 or larger, the core does not become too soft, and the good repulsion would be obtained. The surface hardness H3 of the core is preferably 65 or smaller, more preferably 64 or smaller, and even more preferably 63 or smaller in shore D hardness. If the surface hardness H3 is 65 or smaller in Shore D hardness, since the hardness difference between the core and the intermediate layer can be made larger, the effect of lowering the spin rate on the driver shots becomes larger.

The core of the golf ball of the present invention preferably has a hardness difference (H3−H1) between the surface hardness H3 and the center hardness H1 of 10 or more in Shore D hardness. If the hardness difference (H3−H1) is 10 or more in Shore D hardness, the effect of lowering the spin rate on the driver shot becomes larger. The hardness difference (H3−H1) is preferably 15 or more, more preferably 20 or more in Shore D hardness. The hardness difference (H3−H1) is preferably 35 or less, more preferably 32 or less, even more preferably 30 or less. If the hardness difference is too large, the durability may deteriorate.

The intermediate layer covering the two-layered core will be explained.

The intermediate layer composition for forming the intermediate layer includes, for example, a rubber composition for the center or a resin composition containing a resin component. The intermediate layer composition is preferably a resin composition. That is, the content of the resin component in the intermediate layer composition is 50 mass % or more. Examples of the resin component are an ionomer resin having a trade name "Himilan (registered trademark) (e.g. "Himilan 1605", "Himilan 1706" and "Himilan AM7329")" available from Du Pont-Mitsui Polychemicals Co., Ltd., an ionomer resin having a trade name "Surlyn (registered trademark) (e.g. "Surlyn 8140", "Surlyn 9120" and "Surlyn 8945")" available from E.I. du Pont de Nemours and Company, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A") available from BASF Japan Ltd, a thermoplastic polystyrene elastomer having a trade name "Rabalon (registered trademark) (e.g. "Rabalon T3221C")" commercially available from Mitsubishi Chemical Corporation, and the like. These resins and elastomers may be used solely or in combination of two or more types thereof. Among them, in view of the repulsion, the intermediate layer composition preferably comprises a mixture of the ionomer resin and the thermoplastic styrene elastomer as the resin component.

The intermediate layer composition may further contain a specific gravity adjusting agent, an antioxidant, a pigment and the like appropriately.

Examples of the specific gravity adjusting agent are zinc oxide, barium sulfate, calcium carbonate, magnesium oxide, tungsten, molybdenum and the like. The blending amount of the specific gravity adjusting agent is preferably 1 part or more, more preferably 2 parts or more, even more preferably 3 parts or more, and is preferably 50 parts or less, more preferably 47 parts or less, even more preferably 44 parts or less, with respect to 100 parts of the resin component of the intermediate layer composition by mass. If the blending amount of the specific gravity adjusting agent is 1 part or more by mass, it is easy to adjust the density of the intermediate layer composition, while if the blending amount is 50 parts or less by mass, the dispersibility into the resin component becomes good.

The intermediate layer composition preferably has a density of 1.10 g/cm$^3$ or more, more preferably 1.20 g/cm$^3$ or more, even more preferably 1.30 g/cm$^3$ or more. If the density of the intermediate layer composition is 1.10 g/cm$^3$ or more, the moment of inertia of the golf ball can be made high. Since the effect of lowering the spin rate on the driver shots becomes larger, the flight distance and the direction stability become better. On the other hand, the upper limit of the density of the intermediate layer composition is preferably, but not limited to, 1.8 g/cm$^3$, more preferably 1.6 g/cm$^3$, even more preferably 1.5 g/cm$^3$. The intermediate layer having a high density is preferably disposed in the outer part of the golf ball as much as possible.

In this case, the center composition preferably has a density of 1.15 g/cm$^3$ or less, more preferably 1.13 g/cm$^3$ or less, even more preferably 1.10 g/cm$^3$ or less. If the center composition has the density of 1.15 g/cm$^3$ or less, the moment of inertia of the golf ball can be made high. On the other hand, the cover composition preferably has a density of 0.96 g/cm$^3$ or more, more preferably 0.98 g/cm$^3$ or more, even more preferably 1.00 g/cm$^3$ or more. Further, it is noted that the density of the cover composition is preferably as high as possible, but it is not preferable to add a large amount of the high specific gravity filler to the cover composition, because the high specific gravity filler is generally a colored material.

The intermediate layer composition preferably has a slab hardness (H4) of 35 or more, more preferably 40 or more, even more preferably 45 or more, and preferably has a slab hardness of 55 or less, more preferably 53 or less, even more preferably 50 or less in Shore D hardness. If the intermediate layer composition has a slab hardness (H4) of 35 or more, the repulsion of the golf ball is enhanced. On the other hand, if the intermediate layer composition has a slab hardness of 55 or less, the shot feeling of the golf ball is enhanced. Herein, the slab hardness (H4) of the intermediate layer composition is a measured hardness of the intermediate layer composition that is molded into a sheet form by a measuring method described later.

The slab hardness H4 of the intermediate layer composition, the center hardness H1 of the core, and the surface hardness H3 of the core preferably satisfy the relation of $H1 \leqq H4 < H3$. Satisfying the relation provides better shot feeling.

The intermediate layer is formed, for example, by covering the core with the intermediate layer composition. An embodiment for molding the intermediate layer is not particularly limited, and includes an embodiment which comprises injection molding the intermediate layer composition directly onto the core, or an embodiment which comprises molding the intermediate layer composition into a half hollow-shell, covering the core with the two hollow-shells and subjecting the core with the two hollow-shells to the compression-molding for 1 to 5 minutes at the temperature of 130° C. to 170° C.

The thickness of the intermediate layer is preferably 1.2 mm or less, more preferably 1.1 mm or less, and even more preferably 1.0 mm or less, and is preferably 0.5 mm or more, more preferably 0.6 mm or more, and even more preferably 0.7 mm or more. If the thickness of the intermediate layer is 1.2 mm or less, since the core becomes relatively large, the repulsion of the golf ball is enhanced, while if the thickness of the intermediate layer is 0.5 mm or more, since the effect of the intermediate layer having the high specific gravity becomes large, the moment of inertia becomes high and the much lower spin is obtained.

Embodiments of the core and the intermediate layer include, for example, an embodiment where the core is covered with the single-layered intermediate layer or an embodiment where the core is covered with multi-piece or multi-layered of the intermediate layers.

The shape after covering the core with the intermediate layer preferably has a spherical shape. If the intermediate layer does not have a spherical shape, the cover does not have an even thickness. As a result, there exist some portions where the performance of the cover is lowered. On the other hand, the core generally has the spherical shape, but the core may be provided with a rib on the surface thereof so that the surface of the spherical core is divided by the ribs. For example, the surface of the spherical core is evenly divided by the ribs. In one embodiment, the ribs are preferably formed on the surface of the spherical core in an integrated manner, and in another embodiment, the ribs are formed as an intermediate layer on the surface of the spherical core.

The ribs are preferably formed along an equatorial line and meridians that evenly divide the surface of the spherical core, if the spherical core is assumed as the earth. For example, if the surface of the spherical core is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to obtain the spherical shape. The shape of the ribs, without limitation, includes an arc or an almost arc (for example, a part of the arc is removed to obtain a flat surface at the cross or orthogonal portions thereof).

The golf ball of the present invention has no limitation on the structure thereof, as long as the golf ball comprises a core consisting of a center and a surrounding layer covering the center; at least one intermediate layer covering the core; and a cover covering the intermediate layer. Specific examples of the golf ball of the present invention include a four-piece golf ball comprising a core consisting of a center and a surrounding layer covering the center, an intermediate layer covering the core, and a cover covering the intermediate layer; and a multi-piece golf ball comprising a core consisting of a center and an surrounding layer covering the center, a multi-piece of or multi-layer of intermediate layers covering the core and a cover covering the intermediate layer. Among them, the present invention is suitably applicable to a four-piece golf ball comprising a core consisting of a center and a surrounding layer covering the center, an intermediate layer covering the core and a cover covering the intermediate layer.

When the golf ball of the present invention has a diameter in a range from 40 mm to 45 mm, a compression deformation amount of the golf ball (an amount of compression of the golf ball in the compression direction thereof) when applying an initial load of 98 N to a final load of 1275 N to the golf ball is preferably 2.5 mm or more, more preferably 2.7 mm or more, and even more preferably 3.0 mm or more, and is preferably 4.0 mm or less, more preferably 3.7 mm or less, and even more preferably 3.4 mm or less. By causing the compression deformation amount to be 2.5 mm or more, desirable shot feeling is obtained. By causing the compression deformation amount to be 4.0 mm or less, desirable repulsion is obtained.

EXAMPLES

Hereinafter, the present invention will be described in detail by way of example. The present invention is not limited to examples described below. Various changes and modifications can be made without departing from the spirit and scope of the present invention.

(1) Slab Hardness (Shore D Hardness) of the Cover Composition and the Intermediate Layer Composition Sheets with a thickness of about 2 mm were produced by press molding a cover composition, an intermediate layer composition or a surrounding layer composition, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., provided with a Shore D type spring hardness tester prescribed in ASTM-D2240.

(2) Center Hardness of the Center, and Surface Hardness of the Core and the Center (Shore D Hardness)

A type P1 auto loading durometer manufactured by Kobunshi Keiki Co., Ltd., provided with a Shore D type spring hardness tester prescribed in ASTM-D2240 was used to measure the surface hardness of the center, and the core. Shore D hardness measured at the surfaces of the center and the core are defined as the surface hardness of the center and the core, respectively. The core was cut into two hemispheres to obtain a cut plane, and a Shore D hardness measured at the center of the cut plane was used as the center hardness of the center or the core.

(3) Compression Deformation Amount (mm)

A compression deformation amount of the golf ball, the core or the center (a shrinking amount of the golf ball, the core or the center in the compression direction thereof), when applying an initial load of 98 N to a final load of 1275 N, was measured.

(4) Density of the Intermediate Layer

The intermediate layer composition was formed into a pellet, and the density of the pellet was measured in a solvent of ethanol with ARCHIMEDES available from Chyo balance Corporation.

(5) Flexural Modulus (MPa)

(A) Test pieces with a length of 80.0±2 mm, a width of 10.0±0.2 mm, and a thickness of 4.0±0.2 mm were produced by injection molding using a dry pellet of (A) the polyamide resin composition, and immediately stored at 23° C.±2° C. for 24 hours or more in a moisture-proof container. The test pieces were taken out from the moisture-proof container and immediately (within 15 minutes) the flexural modulus of the test pieces were measured according to ISO178. The measurement was conducted at a temperature of 23° C. and a humidity of 50% RH.

(B) Test pieces with a length of 80.0±2 mm, a width of 10.0±0.2 mm, and a thickness of 4.0±0.2 mm were produced by injection molding using (B) the copolymer and/or a metal-neutralized product thereof or the cover composition, and stored at 23° C. for two weeks under the humidity of 50% RH. The flexural modulus of the test pieces were measured according to ISO178. The measurement was conducted at a temperature of 23° C. and a humidity of 50% RH.

(6) Tensile Modulus (MPa)

A sheet with a thickness of about 2 mm was produced by injection molding a cover composition, and stored at 23° C. for two weeks. A dumbbell-shaped test piece was produced from this sheet, and the tensile modulus of the test piece was measured according to ISO 527-1.

(7) Repulsion Resilience (%)

A sheet with a thickness of about 2 mm was produced by a hot press molding from the cover composition. A circle-shaped test piece having a diameter of 28 mm was cut out of this sheet, and 6 pieces of the test piece were stacked to prepare a cylindrical test piece having a thickness of about 12 mm and a diameter of 28 mm. The cylindrical test piece was subjected to the Lupke type repulsion resilience test (testing temperature 23° C., humidity 50RH %). Preparation of the test piece and the testing method are based on JIS K6255.

(8) Melt Flow Rate (MFR) (g/10 min)

The MFR was measured using a flow tester (Shimadzu flow tester CFT-100C manufactured by Shimadzu Corporation) in accordance with JIS K7210. The measurement was conducted under the conditions of the measurement temperature 240° C. and the load of 2.16 kg and the measurement temperature 240° C. and the load of 5 kg.

(9) Flight Distance

A metal-headed W#1 driver (XXIO S shaft, loft: 10°, manufactured by SRI Sports Limited) was installed on a swing robot M/C manufactured by TRUETEMPER CO. Golf balls were hit at a head speed of 45 m/sec, and the flight distances (the distance from the launch point to the stop point) were measured. This measurement was conducted ten times for each golf ball, and the average value was used as the measurement value for the golf ball.

(10) Direction Stability

A metal-headed W#1 driver (XXIO S shaft, loft: 10°, manufactured by SRI Sports Limited) was installed on a swing robot M/C manufactured by TRUETEMPER CO so that the club face is in a direction orthogonal to the hitting direction. Then, golf balls were hit with a driver having club face open by 2° and close by 2° to the hitting direction, respectively. The distances between the stop points hit with a driver having a club face open by 2° and the stop point hit with a driver having a club face close by 2° were measured. The parallel lines to the hitting direction were drawn to pass through the respective two stop points, and the distance between the parallel lines were measured. This measurement was conducted ten times for each golf ball, and the average value was used as the measurement value for the golf ball.

(11) Normal Temperature Durability

A metal-head driver was installed on a swing robot manufactured by TRUETEMPER CO, and the head speed was set to 45 m/sec. Each golf ball was stored in a constant temperature reservoir kept at the temperature of 23° C. for 12 hours, and then hit with a driver at the speed of 45 m/sec. immediately after the golf balls were taken out from the constant temperature reservoir. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball. The number of hits for golf ball No. 5 was defined as an index of 100, and the normal temperature durability of each golf ball was represented by converting the number of hits for each golf ball into this index. A greater index value indicates that the durability of the golf ball is excellent.

(12) Low Temperature Durability

Ten golf balls for each golf ball were stored in a constant temperature reservoir kept at the temperature of −10° C. for 1 day. The golf balls were made collide with a metal board with an air gun at the speed of 45 m/s, immediately after the golf balls were taken out from the constant temperature reservoir. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball. The number of hits for golf ball No. 4 was defined as an index of 100, and the low-temperature durability of each golf ball was represented by converting the number of hits for each golf ball into this index. A greater index value indicates that the durability of the golf ball is excellent.

(13) Shot Feeling

An actual hitting test was carried out by ten amateur golfers (high skilled person) using a driver (#W1 driver), and the shot feeling was evaluated according to the following four criteria.

E (Excellent): Extremely good (soft feeling)

G (Good): Good (Relatively soft feeling)

F (Fair): Slightly poor (Relatively hard feeling)

P (Poor): Poor (Hard feeling)

[Production of Golf Balls]

(1) Production of Center

Centers were obtained by kneading rubber compositions having the formulation shown in Table 1, and heat-pressing the kneaded material in upper and lower molds, each having a hemispherical cavity, at 170° C. for 20 minutes.

TABLE 1

| | | Center Composition No. | | |
|---|---|---|---|---|
| | | 1 | 2 | 3 |
| Formulation | Polybutadiene | 100 | 100 | 100 |
| | Zinc acrylate | 26 | 25 | 27 |
| | Zinc oxide | 10 | 10 | 10 |
| | Barium sulfate | Appropriate Amount*) | Appropriate Amount*) | Appropriate Amount*) |
| | Diphenyl disulfide | 0.5 | 0.5 | 0.5 |
| | Dicumyl peroxide | 0.8 | 0.8 | 0.8 |

Note on table 1:

Formulation: parts by mass

*)The amount of Barium sulfate was adjusted such that the golf ball had a mass of 45.4 g.

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

It is noted that an appropriate amount of barium sulfate was added such that the obtained golf ball had a mass of 45.4 g.

(2) Preparation of the Surrounding Layer Composition

Blending materials shown in table 2 were mixed and kneaded to obtain the surrounding layer compositions. The obtained surrounding layer compositions were formed into the half hollow-shells. The centers were covered with a pair of the upper and lower half hollow-shells and subjected to the press-molding under the condition of 170° C. for 20 minutes in the upper and lower molds having spherical cavities to form the surrounding layer and obtain spherical cores having two layers.

TABLE 2

| | | Surrounding layer Composition No. 1 |
|---|---|---|
| Formulation | Polybutadiene | 100 |
| | Zinc acrylate | 37 |
| | Zinc oxide | 5 |
| | Barium sulfate | 10 |
| | Diphenyl disulfide | 0.5 |
| | Dicumyl peroxide | 0.8 |

Note on Table 2:

Formulation: parts by mass

Polybutadiene rubber: "BR-730 (high-cis polybutadiene)" manufactured by JSR Corporation.

Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

Diphenyl disulfide: manufactured by Sumitomo Seika Chemicals Co., Ltd.

Dicumyl peroxide: "Percumyl (registered trademark) D" manufactured by NOF Corporation.

(3) Preparation of Cover Composition and Intermediate Layer Composition

Blending materials shown in Tables 3, 5 to 7 were mixed with a twin-screw kneading extruder to prepare cover compositions in the pellet form and intermediate layer compositions in the pellet form, respectively. The extruding conditions were a screw diameter of 45 mm, a screw rotational speed of 200 rpm, and screw L/D=35, and the mixtures were heated to 160 to 230° C. at the die position of the extruder.

TABLE 3

| Intermediate layer composition | | A | B | C | D | E |
|---|---|---|---|---|---|---|
| Formulation | Surlyn 8945 | 35 | 35 | 35 | 35 | 48 |
| | Himilan AM7329 | 35 | 35 | 35 | 35 | 30 |
| | Rabalon T3221C | 30 | 30 | 30 | 30 | 22 |
| | Tungsten | — | 20 | 32 | 43 | 32 |
| Slab hardness H4 (Shore D) | | 47 | 47 | 47 | 47 | 53 |
| Density (g/cm$^3$) | | 0.94 | 1.12 | 1.22 | 1.32 | 1.22 |

Formulation: parts by mass

Note on table 3

Surlyn 8945: Sodium ion neutralized ethylene-methacrylic acid copolymer ionomer resin available from E. I. du Pont de Nemours and Company Himilan AM7329: Zinc ion neutralized ethylene-methacrylic acid copolymer ionomer resin available from Du Pont-Mitsui Polychemicals Co., Ltd Rabalon T3221C: Polystyrene elastomer available from Mitsubishi Chemical Corporation.

Tungsten: Tungsten powder C50G available from A.L.M.T. Corp.

(4) Production of Golf Ball Body

The intermediate layer compositions obtained above were injection-molded onto the spherical cores to form the intermediate layers covering the cores. Subsequently, golf balls were produced by injection-molding the cover composition onto the intermediate layer to form a cover. Upper and lower molds have a spherical cavity with pimples, a part of which serves as a hold pin which is extendable and retractable. The hold pins were protruded to hold the core, the resin heated to 210° C. was charged into the mold under a pressure of 80 tons within 0.3 seconds, and cooled for 30 seconds. Then, the mold was opened, and the golf ball body were taken out from the mold. The surface of the obtained golf ball body were treated with sandblast, marked, and painted with a clear paint. The paint was dried in an oven at 40° C., and golf balls having Et diameter of 42.8 mm and a mass of 45.4 g were obtained.

Figure 2:
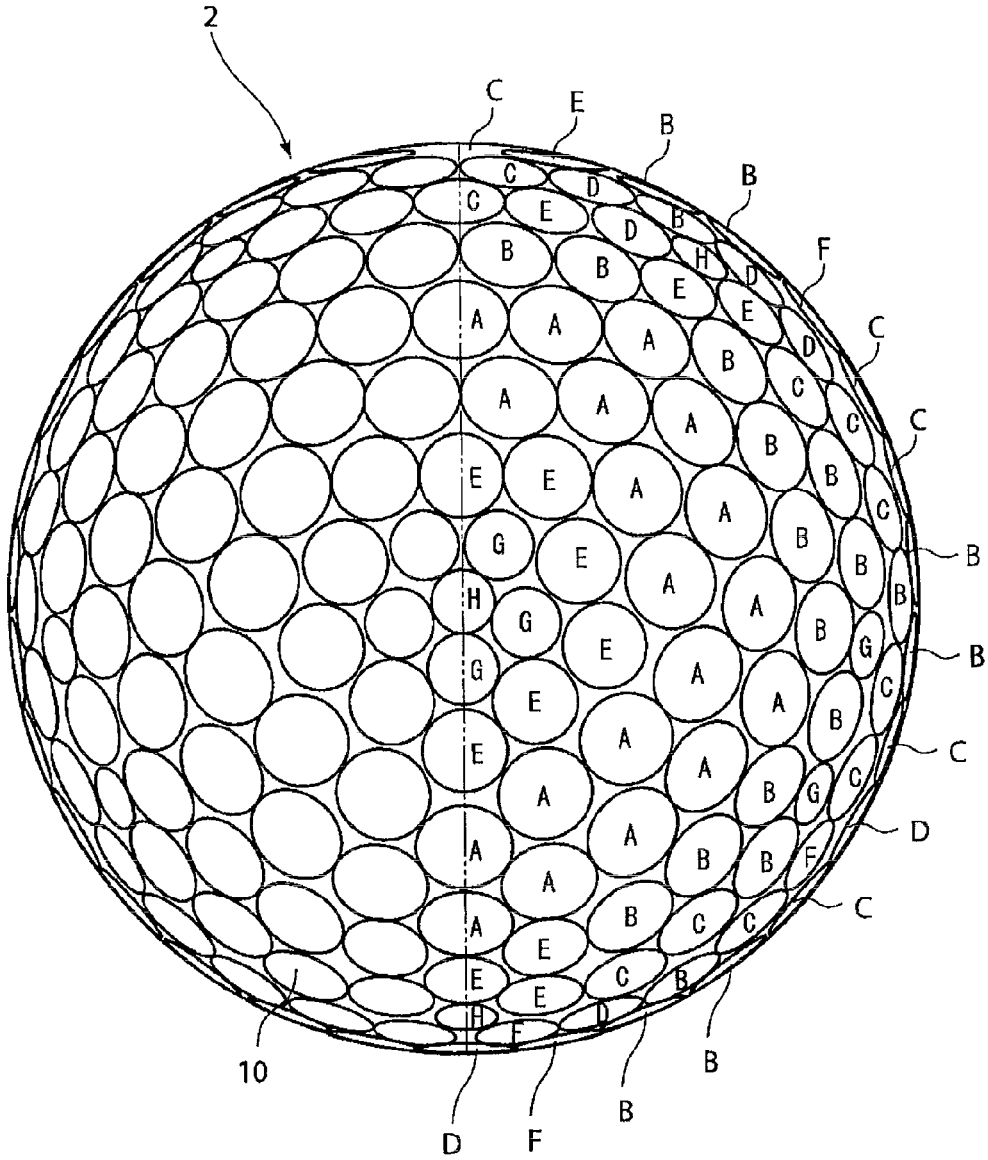
FIG. 2 is a top plan view of the dimple pattern formed on the surface of the golf ball.
Figure 3:
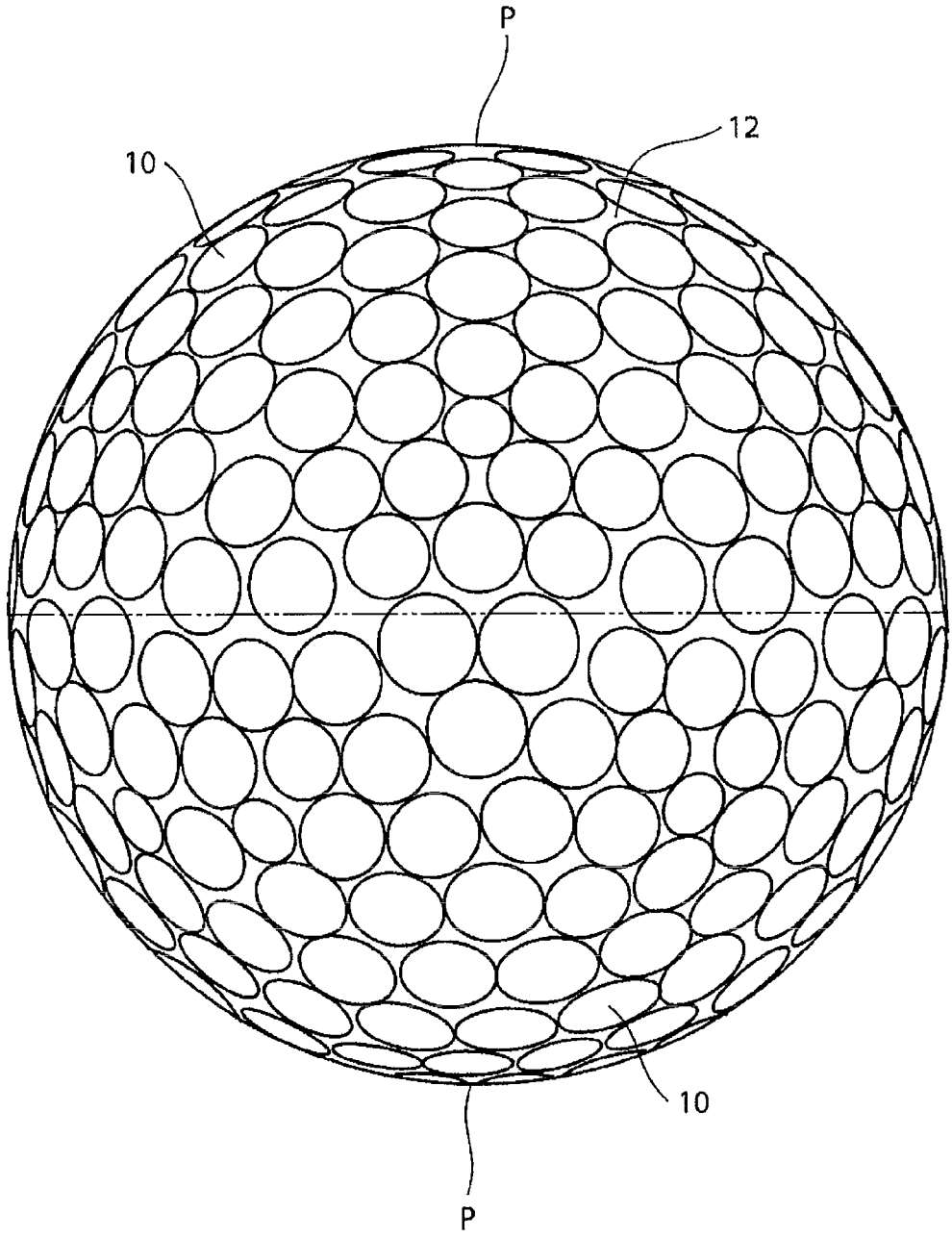
FIG. 3 is a front view of the dimple pattern formed on the surface of the golf ball.

The dimple patterns shown in table 4 and FIG. 2 and FIG. 3 were formed on the surface of the golf ball. In table 4, "diameter" of the dimple is depicted by Di in FIG. 1, "depth" means a distance between the tangential line and the deepest portion De, "Curvature Radius" means curvature radius of the bottom curved surface of the dimples; and "Area" is calculated by the equation: Area=$(Di/2)^2*\pi$, "Occupancy" means the ratio of the sum of the area of all the dimples 10 to the surface area of the virtual sphere 14. P means Pole in FIG. 3.

TABLE 4

| Kinds | Number | Diameter (mm) | Depth (mm) | Curvature radius (mm) | Area (mm$^2$) | Occupancy (%) | Plan view | Front view |
|---|---|---|---|---|---|---|---|---|
| A | 70 | 4.65 | 0.1380 | 19.65 | 1188.2 | 82.1 | FIG. 2 | FIG. 3 |
| B | 88 | 4.45 | 0.1380 | 18.01 | 1368.0 | | | |
| C | 56 | 4.30 | 0.1380 | 16.82 | 812.8 | | | |
| D | 26 | 4.20 | 0.1380 | 16.05 | 360.0 | | | |
| E | 42 | 4.10 | 0.1380 | 15.30 | 554.2 | | | |
| F | 20 | 3.90 | 0.1380 | 13.85 | 238.8 | | | |
| G | 18 | 3.20 | 0.1380 | 9.34 | 144.7 | | | |
| H | 8 | 3.00 | 0.1380 | 8.22 | 56.5 | | | |
| Total | 328 | — | — | — | 4723.2 | | | |

The results of evaluations about the compression deformation amount, flight distance, direction stability, durability at normal and low temperatures, and shot feeling of the golf balls were shown in tables 5 to 7.

TABLE 5

| Golf ball No. | | | | 1 | 2 | 3 | 4 | 5 |
|---|---|---|---|---|---|---|---|---|
| Core | Center composition No. | | | 1 | 1 | 1 | 2 | 2 |
| | Center | Diameter (mm) | | 31.4 | 31.4 | 31.4 | 31.4 | 25.0 |
| | | Center hardness H1 (Shore D) | | 33 | 33 | 33 | 32 | 32 |
| | | Surface hardness H2 (Shore D) | | 51 | 51 | 51 | 50 | 50 |
| | | Compression deformation amount (mm) | | 4.7 | 4.7 | 4.7 | 4.9 | 4.9 |
| | Surrounding layer composition No. | | | 1 | 1 | 1 | 1 | 1 |
| | Thickness (mm) | | | 4.2 | 4.2 | 4.2 | 4.2 | 7.4 |
| | Properties | Core diameter (mm) | | 39.8 | 39.8 | 39.8 | 39.8 | 39.8 |
| | | Core surface hardness H3 (Shore D) | | 61 | 61 | 61 | 61 | 61 |
| | | Hardness difference(H3 − H1) (Shore D) | | 28 | 28 | 28 | 29 | 29 |
| | | Compression deformation amount (mm) | | 3.5 | 3.5 | 3.5 | 3.6 | 3.4 |
| Intermediate layer | Intermediate layer composition No. | | | B | C | D | E | C |
| | Slab hardness H4 | | Shore D | 47 | 47 | 47 | 53 | 47 |
| | Density | | g/cm$^3$ | 1.12 | 1.22 | 1.32 | 1.22 | 1.22 |
| | Thickness | | (mm) | 0.8 | 0.8 | 0.8 | 0.8 | 0.8 |
| Cover composition | Formulation | (B) | SURLYN 8945 | 20 | 20 | 20 | 20 | 20 |
| | | | HIMILAN AM7329 | 20 | 20 | 20 | 20 | 20 |
| | | (C) | NUCREL N2050H | — | — | — | — | — |
| | | | Magnesium stearate | 5 | 5 | 5 | 5 | 5 |
| | | (A) | NOVAMID ST120 | 60 | 60 | 60 | 60 | 60 |
| | | Titanium oxide | | 4 | 4 | 4 | 4 | 4 |
| | Slab | Slab hardness H5 (Shore D) | | 70 | 70 | 70 | 70 | 70 |
| | Properties | Flexural modulus (MPa) | | 653 | 653 | 653 | 653 | 653 |

TABLE 5-continued

| | | | Golf ball No. | 1 | 2 | 3 | 4 | 5 |
|---|---|---|---|---|---|---|---|---|
| | | | Tensile modulus (MPa) | 804 | 804 | 804 | 804 | 804 |
| | | | Repulsive modulus (%) | 48 | 48 | 48 | 48 | 48 |
| | | | MFR (240° C., 2.16 kg) (g/10 min) | 18.3 | 18.3 | 18.3 | 18.3 | 18.3 |
| | | | MFR (240° C., 5 kg) (g/10 min) | — | — | — | — | — |
| | | | Cover thickness (mm) | 0.7 | 0.7 | 0.7 | 0.7 | 0.7 |
| Golf ball evaluation | Compression deformation amount (mm) | | | 3.1 | 3.1 | 3.1 | 3.2 | 3.0 |
| | Flight distance (m) | | | 236 | 238 | 241 | 238 | 240 |
| | Direction stability (m) | | | 5.2 | 3.8 | 3.6 | 4.1 | 3.4 |
| | Normal-temperature Durability | | | 109 | 109 | 110 | 100 | 106 |
| | Low-temperature Durability | | | 118 | 119 | 116 | 100 | 115 |
| | Shot feeling | | | E | E | E | G | E |

TABLE 6

| | | | | Golf ball No. | 6 | 7 | 8 | 9 | 10 |
|---|---|---|---|---|---|---|---|---|---|
| Core | Center composition No. | | | | 1 | 1 | 1 | 1 | 1 |
| | Center | Diameter (mm) | | | 32.0 | 31.0 | 31.8 | 30.8 | 31.4 |
| | | Center hardness H1 (Shore D) | | | 33 | 33 | 33 | 33 | 33 |
| | | Surface hardness H2 (Shore D) | | | 51 | 51 | 51 | 51 | 51 |
| | | Compression deformation amount (mm) | | | 4.7 | 4.7 | 4.7 | 4.7 | 4.7 |
| | Surrounding layer composition No. | | | | 1 | 1 | 1 | 1 | 1 |
| | Thickness (mm) | | | | 4.2 | 4.2 | 4.2 | 4.2 | 4.2 |
| | Properties | Core diameter (mm) | | | 40.4 | 39.4 | 40.2 | 39.2 | 39.8 |
| | | Core surface hardness H3 (Shore D) | | | 61 | 61 | 61 | 61 | 61 |
| | | Hardness difference(H3 − H1) (Shore D) | | | 28 | 28 | 28 | 28 | 28 |
| | | Compression deformation amount (mm) | | | 3.5 | 3.5 | 3.5 | 3.5 | 3.5 |
| Intermediate layer | Intermediate layer composition No. | | | | C | C | C | C | A |
| | Slab hardness H4 | | Shore D | | 47 | 47 | 47 | 47 | 47 |
| | Density | | $g/cm^3$ | | 1.22 | 1.22 | 1.22 | 1.22 | 0.94 |
| | Thickness | | (mm) | | 0.5 | 1.0 | 0.8 | 0.8 | 0.8 |
| Cover composition | Formulation | (B) | SURLYN 8945 | | 20 | 20 | 20 | 20 | 20 |
| | | | HIMILAN AM7329 | | 20 | 20 | 20 | 20 | 20 |
| | | (C) | NUCREL N2050H | | — | — | — | — | — |
| | | | Magnesium stearate | | 5 | 5 | 5 | 5 | 5 |
| | | (A) | NOVAMID ST120 | | 60 | 60 | 60 | 60 | 60 |
| | | Titanium oxide | | | 4 | 4 | 4 | 4 | 4 |
| | Slab | Slab hardness H5 (Shore D) | | | 70 | 70 | 70 | 70 | 70 |
| | Properties | Flexural modulus (MPa) | | | 653 | 653 | 653 | 653 | 653 |
| | | Tensile modulus (MPa) | | | 804 | 804 | 804 | 804 | 804 |
| | | Repulsive modulus (%) | | | 48 | 48 | 48 | 48 | 48 |
| | | MFR (240° C., 2.16 kg) (g/10 min) | | | 18.3 | 18.3 | 18.3 | 18.3 | 18.3 |
| | | MFR (240° C., 5 kg) (g/10 min) | | | — | — | — | — | — |
| | | Cover thickness (mm) | | | 0.7 | 0.7 | 0.5 | 1.0 | 0.7 |
| Golf ball evaluation | Compression deformation amount (mm) | | | | 3.2 | 3.1 | 3.2 | 3.0 | 3.1 |
| | Flight distance (m) | | | | 239 | 238 | 240 | 237 | 231 |
| | Direction stability (m) | | | | 3.9 | 3.9 | 3.7 | 4.0 | 8.9 |
| | Normal-temperature Durability | | | | 107 | 111 | 105 | 110 | 108 |
| | Low-temperature Durability | | | | 118 | 120 | 114 | 119 | 117 |
| | Shot feeling | | | | E | E | E | E | E |

TABLE 7

| | | | | Golf ball No. | 11 | 12 | 13 | 14 | 15 |
|---|---|---|---|---|---|---|---|---|---|
| Core | Center composition No. | | | | 3 | 1 | 1 | 1 | 1 |
| | Center | Diameter (mm) | | | 35.5 | 31.4 | 31.4 | 30.4 | 30.4 |
| | | Center hardness H1 (Shore D) | | | 33 | 33 | 33 | 33 | 33 |
| | | Surface hardness H2 (Shore D) | | | 51 | 51 | 51 | 51 | 51 |
| | | Compression deformation amount (mm) | | | 4.5 | 4.7 | 4.7 | 4.7 | 4.7 |
| | Surrounding layer composition No. | | | | 1 | 1 | 1 | 1 | 1 |
| | Thickness (mm) | | | | 2.2 | 4.2 | 4.2 | 4.2 | 4.2 |
| | Properties | Core diameter (mm) | | | 39.9 | 39.8 | 39.8 | 38.8 | 38.8 |
| | | Core surface hardness H3 (Shore D) | | | 61 | 61 | 61 | 61 | 61 |
| | | Hardness difference(H3 − H1) (Shore D) | | | 28 | 28 | 28 | 28 | 28 |
| | | Compression deformation amount (mm) | | | 3.5 | 3.5 | 3.5 | 3.5 | 3.5 |
| Intermediate layer | Intermediate layer composition No. | | | | C | C | C | C | C |
| | Slab hardness H4 | | Shore D | | 47 | 47 | 47 | 47 | 47 |
| | Density | | $g/cm^3$ | | 1.22 | 1.22 | 1.22 | 1.22 | 1.22 |
| | Thickness | | (mm) | | 0.8 | 0.8 | 0.8 | 1.3 | 0.8 |
| Cover composition | Formulation | (B) | SURLYN 8945 | | 20 | 20 | 20 | 20 | 20 |
| | | | HIMILAN AM7329 | | 20 | 20 | 20 | 20 | 20 |
| | | (C) | NUCREL N2050H | | — | 10 | 25 | — | — |

TABLE 7-continued

| | | Golf ball No. | 11 | 12 | 13 | 14 | 15 |
|---|---|---|---|---|---|---|---|
| | | Magnesium stearate | 5 | — | — | 5 | 5 |
| | | (A) NOVAMID ST120 | 60 | 60 | 60 | 60 | 60 |
| | | Titanium oxide | 4 | 4 | 4 | 4 | 4 |
| | Slab Properties | Slab hardness H5 (Shore D) | 70 | 68 | 64 | 70 | 70 |
| | | Flexural modulus (MPa) | 653 | 448 | 272 | 653 | 653 |
| | | Tensile modulus (MPa) | 804 | 702 | 405 | 804 | 804 |
| | | Repulsive modulus (%) | 48 | 49 | 46 | 48 | 48 |
| | | MFR (240° C., 2.16 kg) (g/10 min) | 18.3 | 4.6 | 24.3 | 18.3 | 18.3 |
| | | MFR (240° C., 5 kg) (g/10 min) | — | 49 | — | — | — |
| | | Cover thickness (mm) | 0.7 | 0.7 | 0.7 | 0.7 | 1.2 |
| Golf ball Evaluation | Compression deformation amount (mm) | | 3.1 | NG | 3.3 | 2.9 | 2.9 |
| | Flight distance (m) | | 232 | | 231 | 232 | 232 |
| | Direction stability (m) | | 7.3 | | 7.2 | 8.5 | 10.1 |
| | Normal-temperature Durability | | 106 | | 112 | 111 | 115 |
| | Low-temperature Durability | | 114 | | 120 | 119 | 122 |
| | Shot feeling | | E | | E | G | G |

Notes on tables 5 to 7

Formulation: parts by mass

NG: Impossible to mold

Surlyn 8945: Sodium ion neutralized ethylene-methacrylic acid copolymer ionomer resin (Melt viscosity (190° C.) measured by a flow tester: 1,000 Pa · s) available from E. I. du Pont de Nemours and Company Himilan AM7329: Zinc ion neutralized ethylene-methacrylic acid copolymer ionomer resin (Melt viscosity (190° C.) measured by a flow tester: 1,100 Pa · s) available from Du Pont-Mitsui Polychemicals Co., Ltd Nucrel 2050H: ethylene-methacrylic acid copolymer (melt viscosity (190° C.) measured by a flow tester: 8 Pa · s, melt flow rate (190° C.*2.16 kg): 500 g/10 min) available from Du Pont-Mitsui Polychemicals Co., Ltd.

Magnesium stearate: Yoneyama Yakuhin Kogyo CO., LTD

NOVAMID ST120: a mixed resin of polyamide 6 and a resin having at least one functional group selected from the group consisting of a hydroxyl group, a carboxyl group, an anhydride group, a sulfonic acid group, and an epoxy group (including a glycidyl group), (flexural modulus: 2,000 MPa, melt flow rate (240° C., 2.16 kg): 30 g/10 min) available from Mitsubishi Engineering-Plastics Company.

Each of Golf balls No. 1 to 9 is the case that the cover is formed from the cover composition that contains (A) component, (B) component, and (C) component; the cover has a thickness ranging from 0.3 mm to 1.0 mm; the cover composition has a slab hardness H5 from 65 to 75 in Shore D hardness; the intermediate layer has a thickness ranging from 0.5 mm to 1.2 mm and a density of 1.10 g/cm$^3$ or more; and the center has a diameter of 35 mm or less. It is clear that golf balls No. 1 to 9 have improved flight distance, direction stability, durability at normal and low temperatures, and shot feeling. If the golf balls No. 1, 3 are compared, the intermediate layer composition having a higher density provides better direction stability.

Golf ball No. 10 is the case that the intermediate layer has a density of less than 1.10 g/cm$^3$. The durability at normal and low temperatures and shot feeling were excellent, but the flight distance and the direction stability were poor. Golf ball No. 11 is the case that the center has a diameter of more than 35 mm. The flight distance and the direction stability were inferior, although the durability at normal and low temperatures and the shot feeling were excellent.

Golf ball No. 12 is the case that the cover composition has a MFR (240° C., 2.16 kg) of less than 5.0 g/10 min. Due to the poor fluidity of the cover composition, it was impossible to mold the cover. Golf ball No. 13 is the case that the cover composition has a slab hardness H5 less than 65 in Shore D hardness. The flight distance was not improved, although the durability at normal and low temperatures and the shot feeling were improved.

Golf ball Nos. 14 and 15 are the cases that the intermediate layers has a thickness of more than 1.2 mm (golf ball No. 14) and the cover has a thickness of more than 1.0 mm (golf ball No. 15), although the same cover composition as those of golf balls Nos. 1 to 9 were used. The flight distance and the direction stability were inferior, although the durability at normal and low temperatures was improved.

According to the present invention, a golf ball excellent in the durability at the normal and low temperatures, flight distance, direction stability and shot feeling on the shots is obtained. This application is based on Japanese Patent applications No. 2008-335264 filed on Dec. 26, 2008, the contents of which are hereby incorporated by reference.

The invention claimed is:

1. A golf ball comprising:

a core consisting of a center having a diameter of 35 mm or less and a surrounding layer covering the center;

at least one intermediate layer covering the core, said intermediate layer having a thickness ranging from 0.5 mm to 1.2 mm and a density of 1.10 g/cm$^3$ or more; and a cover covering the intermediate layer and having a thickness ranging from 0.3 mm to 1.0 mm, wherein the cover is formed of a cover composition that has a slab hardness ranging from 65 to 75 in Shore D hardness and contains as a resin component;

(A) a polyamide resin composition having a flexural modulus in a range from 700 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group);

(B) at least one member selected from the group consisting of an ethylene-(meth)acrylic acid binary copolymer, a metal-neutralized product of the binary copolymer, an ethylene-(meth)acrylic acid-(meth)acrylic acid ester ternary copolymer, and a metal-neutralized product of the ternary copolymer; and (C) a fluidity improving agent.

2. The golf ball according to claim 1, wherein a content ratio ((A)/(B)) of (A) component to (B) component (a total is 100 mass %) in the cover composition is 20 mass % to 80 mass %/80 mass % to 20 mass %, and a blending amount of (C) the fluidity improving agent in the cover composition is from 1 part to 30 parts by mass with respect to 100 parts by mass of a sum of (A) component and (B) component.

3. The golf ball according to claim 1, wherein regarding slab properties, the cover composition has a flexural modulus in a range from 400 MPa to 1,000 MPa.

4. The golf ball according to claim 1, wherein (a-1) the polyamide resin is at least one member selected from the group consisting of polyamide 6, polyamide 11, polyamide 12, polyamide 66, polyamide 610, polyamide 6T, polyamide 6I, polyamide 9T, polyamide M5T, polyamide 612 and a polyetherblock amide copolymer.

5. The golf ball according to claim 1, wherein (a-2) the resin having at least one functional group selected from the group consisting of a hydroxyl group, a carboxyl group, an anhydride group, a sulfonic acid group, and an epoxy group (including a glycidyl group) is a thermoplastic elastomer having at least one functional group selected from the group consisting of a hydroxyl group, a carboxyl group, an anhydride group, a sulfonic acid group, and an epoxy group (including a glycidyl group).

6. The golf ball according to claim 5, wherein the thermoplastic elastomer contains at least one member selected from the group consisting of a thermoplastic polyolefin elastomer, a thermoplastic polyester elastomer, a thermoplastic polyimide elastomer, a thermoplastic polyurethane elastomer, and a thermoplastic polystyrene elastomer.

7. The golf ball according to claim 6, wherein the thermoplastic elastomer is a thermoplastic polystyrene elastomer.

8. The golf ball according to claim 1, wherein (B) component is the metal-neutralized product of the ethylene-(meth) acrylic acid binary copolymer or the metal-neutralized product of the ethylene-(meth)acrylic acid-(meth)acrylic acid ester ternary copolymer, which is neutralized with at least one metal ion selected from the group consisting of Li, Na, Ca, Zn, Mg and Cu.

9. The golf ball according to claim 1, wherein (C) the fluidity improving agent includes at least one selected from the group consisting of a fatty acid, a metal salt thereof, a nonionic thermoplastic resin having a melt viscosity (190° C.) ranging from 5 Pa·s to 1,000 Pa·s measured by a flow tester, and an ionomer resin having a melt viscosity (190° C.) ranging from 1 Pa·s to 10 Pa·s measured by a brookfield viscometer.

10. The golf ball according to claim 1, wherein a center hardness (H1) of the core, a slab hardness (H4) of the intermediate layer, and a surface hardness (H3) of the core satisfy an equation $H1 \leqq H4 < H3$.

11. The golf ball according to claim 1, wherein the center and the surrounding layer contain a rubber component as a main component, and the intermediate layer contains a thermoplastic material as a main component.

12. The golf ball according to claim 1, wherein the cover composition has a melt flow rate (240° C., 2.16 kg) ranging from 5.0 g/10 min to 50.0 g/10 min.

13. The golf ball according to claim 1, wherein the cover composition has a tensile strength ranging from 400 MPa to 2,000 MPa.

14. The golf ball according to claim 1, wherein the surrounding layer has a thickness ranging from 2 mm to 15 mm.

15. The golf ball according to claim 1, wherein the core has a compression deformation amount from 2.7 mm to 4.5 mm, when applying an initial load of 98 N to a final load of 1275 N to the core.

16. The golf ball according to claim 1, wherein the core has a center hardness H1 ranging from 22 to 42 in Shore D hardness.

17. The golf ball according to claim 1, wherein the center has a surface hardness H2 ranging from 44 to 60 in Shore D hardness.

18. The golf ball according to claim 1, wherein the core has a surface hardness H3 ranging from 55 to 65 in Shore D hardness.

19. The golf ball according to claim 1, wherein the intermediate layer has a slab hardness H4 ranging from 35 to 55 in Shore D hardness.

20. The golf ball according to claim 1, wherein the golf ball has a compression deformation amount from 2.5 mm to 4.0 mm, when applying an initial load of 98 N to a final load of 1275 N to the golf ball.

* * * * *